US008317935B2

(12) United States Patent
Haeberle et al.

(10) Patent No.: US 8,317,935 B2
(45) Date of Patent: Nov. 27, 2012

(54) DISHWASHER APPARATUS INCLUDING SOUND ABSORBING DEVICE

(75) Inventors: Robert Joseph Haeberle, New Bern, NC (US); Dennis Allen Poyner, Kinston, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 1573 days.

(21) Appl. No.: 11/565,737

(22) Filed: Dec. 1, 2006

(65) Prior Publication Data

US 2008/0128005 A1 Jun. 5, 2008

(51) Int. Cl.
*B08B 3/00* (2006.01)

(52) U.S. Cl. ..... 134/56 D; 134/58 D

(58) Field of Classification Search ..... None
See application file for complete search history.

(56) References Cited

U.S. PATENT DOCUMENTS

| | | | |
|---|---|---|---|
| 2,655,024 | A | 10/1953 | Sway |
| 3,147,914 | A | 9/1964 | Hatten et al. |
| 3,294,102 | A | 12/1966 | Ruspino et al. |
| 3,458,241 | A | 7/1969 | Barnard et al. |
| 3,612,714 | A | 10/1971 | Ruspino |
| 4,889,209 | A | 12/1989 | Sears |
| 4,985,106 | A | 1/1991 | Nelson |
| 5,044,705 | A | 9/1991 | Nelson |
| 5,117,642 | A | 6/1992 | Nakanishi et al. |
| 5,125,241 | A | 6/1992 | Nakanishi et al. |
| 5,127,235 | A | 7/1992 | Nakanishi et al. |
| 5,143,513 | A | 9/1992 | Ellingson et al. |
| 5,152,259 | A | 10/1992 | Bell |
| 5,253,486 | A | 10/1993 | Sugahara et al. |
| 5,388,956 | A | 2/1995 | Pla et al. |
| 5,428,965 | A | 7/1995 | Grunwald et al. |
| 5,487,528 | A | 1/1996 | Richmond |
| 5,499,301 | A | 3/1996 | Sudo et al. |
| 5,503,172 | A | 4/1996 | Hedeen et al. |
| 5,549,760 | A | 8/1996 | Becker |
| 5,878,603 | A | 3/1999 | Warren, Jr. et al. |
| 5,965,851 | A | 10/1999 | Herreman et al. |
| 6,152,259 | A | 11/2000 | Freist et al. |
| 6,293,289 | B1 | 9/2001 | Hapke et al. |
| 6,512,831 | B1 | 1/2003 | Herreman et al. |
| 6,514,889 | B1 | 2/2003 | Théorêt et al. |
| 6,539,955 | B1 | 4/2003 | Tilton et al. |

(Continued)

FOREIGN PATENT DOCUMENTS

CA 2 330 369 A1 9/2001

(Continued)

OTHER PUBLICATIONS

Indian Plastic Portal, IndiaMART InterMESH Limited, [retrieved on May 21, 2009]. Retrieved from the Internet: <URL: http://www.indianplasticportal.com/pptalc.html>.*

(Continued)

*Primary Examiner* — Michael Barr
*Assistant Examiner* — Jason Ko
(74) *Attorney, Agent, or Firm* — Alston & Bird LLP

(57) ABSTRACT

A dishwasher apparatus includes a cover member and a sound absorbing device. The sound absorbing device comprises a sound absorbing element attached to the cover member and a motor guard attached to the sound absorbing element. A portion of the motor guard is positioned between a portion of the motor and a portion of the sound absorbing element.

20 Claims, 5 Drawing Sheets

U.S. PATENT DOCUMENTS

| | | | | |
|---|---|---|---|---|
| 6,654,467 | B1 | 11/2003 | York et al. | |
| 6,662,814 | B2 | 12/2003 | Tobbe et al. | |
| 6,798,799 | B2 | 9/2004 | Jang et al. | |
| 6,807,700 | B2 | 10/2004 | Panther et al. | |
| 2002/0134615 | A1 | 9/2002 | Herreman et al. | |
| 2003/0213271 | A1 | 11/2003 | Lim et al. | |
| 2004/0079400 | A1 | 4/2004 | Young | |
| 2004/0084068 | A1 | 5/2004 | Hur et al. | |
| 2004/0169118 | A1* | 9/2004 | Talaucher et al. | 248/314 |
| 2004/0206377 | A1 | 10/2004 | Griffin et al. | |
| 2004/0238015 | A1 | 12/2004 | Beer et al. | |
| 2004/0244436 | A1 | 12/2004 | Park et al. | |
| 2004/0261434 | A1 | 12/2004 | Zentner et al. | |
| 2004/0261469 | A1 | 12/2004 | Park et al. | |
| 2004/0265553 | A1 | 12/2004 | Rockwell et al. | |
| 2005/0022847 | A1 | 2/2005 | Nito et al. | |
| 2005/0028850 | A1 | 2/2005 | Nito et al. | |
| 2005/0076938 | A1 | 4/2005 | Jordan et al. | |
| 2005/0092353 | A1 | 5/2005 | Retsema | |
| 2005/0136235 | A1 | 6/2005 | Rockwell | |
| 2005/0188472 | A1 | 9/2005 | Park et al. | |
| 2005/0241683 | A1 | 11/2005 | Jeong | |
| 2005/0257816 | A1 | 11/2005 | Kim | |
| 2006/0010935 | A1 | 1/2006 | Park et al. | |
| 2006/0037630 | A1 | 2/2006 | Griffin et al. | |

FOREIGN PATENT DOCUMENTS

| | | | |
|---|---|---|---|
| CN | 1464619 | A | 12/2003 |
| CN | 1464620 | A | 12/2003 |
| DE | 90 13 663 | U1 | 4/1992 |
| EP | 0 657 575 | A1 | 6/1995 |
| JP | 7-171291 | A | 7/1995 |

OTHER PUBLICATIONS

Internet Archive: Wayback Machine, [retrieved on Jul. 25, 2010, archived on Oct. 21, 2004]. Retrieved from the Internet: <URL: http://web.archive.org/web/20041021112604/www.indianplasticportal.com/pptalc.html>.*

* cited by examiner

DISHWASHER APPARATUS INCLUDING SOUND ABSORBING DEVICE

FIELD OF THE INVENTION

The present invention relates to dishwasher apparatus, and more particularly, to dishwasher apparatus with a sound absorbing device.

BACKGROUND OF THE INVENTION

Conventional dishwashers typically include a motor cavity located underneath a wash tub. Components located within the motor cavity typically produce sound that may pass to the surrounding environment. U.S. patent application Publication No. U.S. 2005/0092353, published May 5, 2005, describes a dishwasher with a sound attenuator for attenuating the sound emanating from the motor cavity of a conventional dishwasher. More specifically, the referenced publication discloses a sound attenuator comprising a sound barrier for blocking the transfer of sound from the motor cavity and a sound absorber for absorbing sound from the motor cavity. The sound absorber absorbs sound emanating from the motor cavity and the sound barrier blocks the sound that is not absorbed from passing through the sound absorber and the access panel. The referenced publication states that a suitable sound absorber can comprise a VersaMat® sound absorber sold by Owens Corning.

There is a need to provide dishwasher apparatus including a sound absorbing device with a sound absorbing element and a motor guard.

SUMMARY OF THE INVENTION

In accordance with one aspect, a dishwasher apparatus comprises a wash tub, a motor cavity, and a motor positioned within the motor cavity. The dishwasher apparatus further includes a cover member configured to substantially cover an access opening into the motor cavity and a sound absorbing device. The sound absorbing device comprises a sound absorbing element attached to the cover member and a motor guard attached to the sound absorbing element. A portion of the motor guard is positioned between a portion of the motor and a portion of the sound absorbing element.

In accordance another aspect, a dishwasher apparatus comprises a cover member and a sound absorbing device. The sound absorbing device comprises a motor guard and an acoustical insulation blanket. The acoustical insulation blanket includes a first side including a first area facing a first direction and a second side including a second area facing a second direction opposite the first direction. The cover member is attached to the first side of the acoustical insulation blanket and the motor guard is attached to the second side of the acoustical insulation blanket. A portion of the acoustical insulation blanket is positioned between a portion of the cover member and the motor guard. The motor guard substantially covers less than about 75% of the second area of the acoustical insulation blanket.

In accordance still another aspect, a dishwasher apparatus comprises a wash tub, a motor cavity, and a motor positioned within the motor cavity. The dishwasher apparatus further comprises cover member configured to substantially cover an access opening into the motor cavity and a sound absorbing device comprising an acoustical insulation blanket. The acoustical insulation blanket includes a first side having a first area facing a first direction and a second side including a second area facing a second direction opposite the first direction. The first side of the acoustical insulation blanket is attached to the cover member. The sound absorbing device further includes a motor guard attached to the second side of the acoustical insulation blanket and substantially covering less than about 75% of the second area of the acoustical insulation blank. A portion of the motor guard is positioned between a portion of the motor and a portion of the acoustical insulation blanket.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF EXAMPLE EMBODIMENTS

Figure 1:
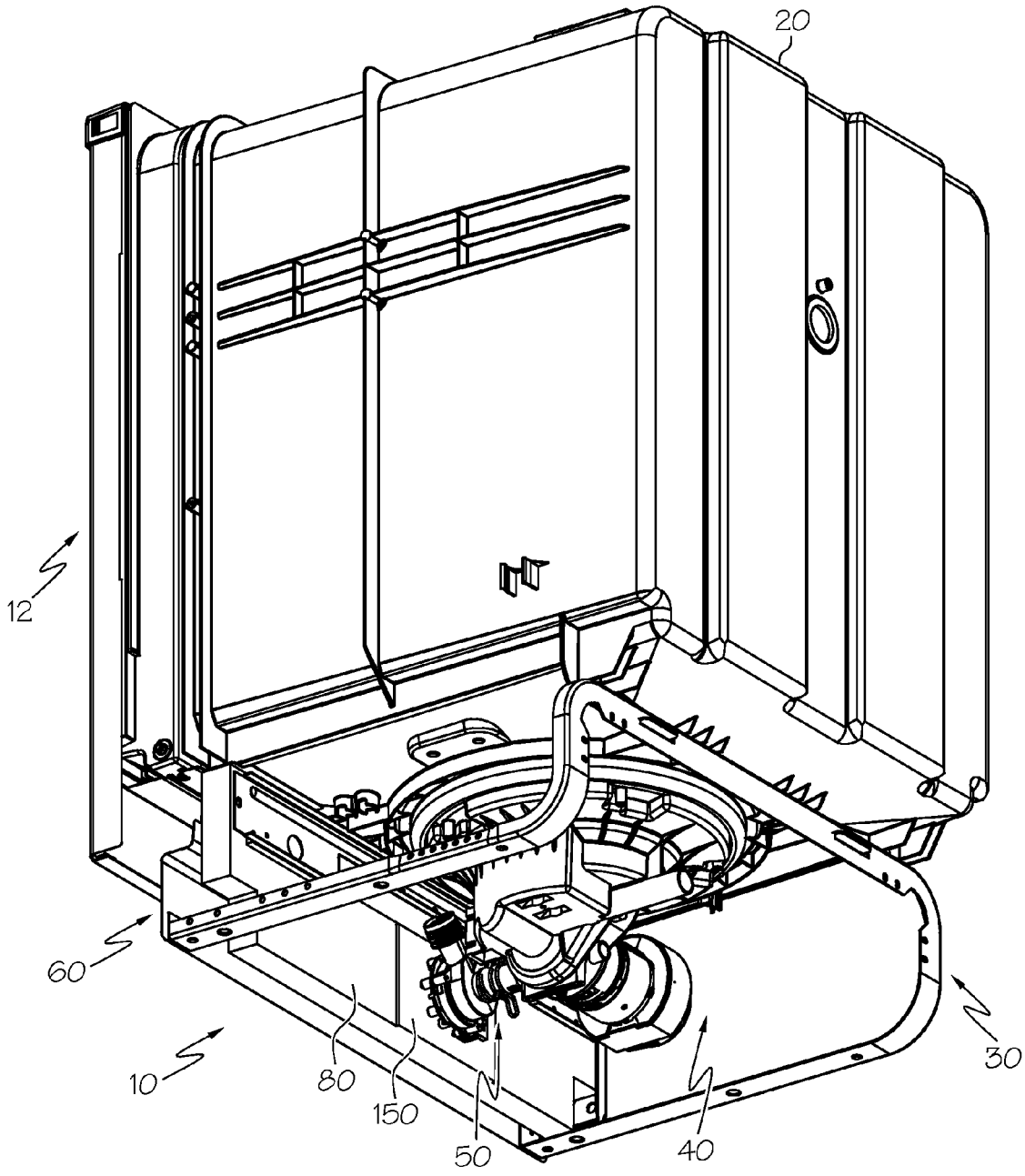
FIG. 1 is a lower perspective view of portions of an example dishwasher apparatus incorporating aspects of the present invention.

Certain terminology is used herein for convenience only and is not to be taken as a limitation on the present invention. Further, in the drawings, the same reference numerals are employed for designating the same elements.

FIG. 1 depicts one example of a dishwasher apparatus 10 in accordance with aspects of the present invention. Dishwasher apparatus 10 herein may include a wash tub 20 configured to receive a wide range of articles for conducting a dishwashing cycle. For example, the wash tub 20 may be designed to receive and support articles such as pots, pans, plates, bowls, utensils (e.g., knives, forks, spoons, spatulas, ladles, etc.), glassware, drinking vessels (e.g., cups, mugs, glasses, stemware, etc.) or the like.

Various wash tubs 20 may be used in accordance with aspects of the present invention. In the illustrated example, the wash tub 20 comprises a side loading tub arrangement although top loading or other arrangements may be incorporated in further examples. The tub 20 can comprise a variety of materials such as plastic, metal, or other material types. The tub 20 includes an opening that may be provided with a closure, such as a dishwasher door 12. The dishwasher door 12 can be designed to pivot from the closed orientation illustrated in FIG. 2 to an open orientation (not shown) by grasping a handle and pivoting the dishwasher door 12 in direction 13 about a pivot axis 14.

Figure 3:
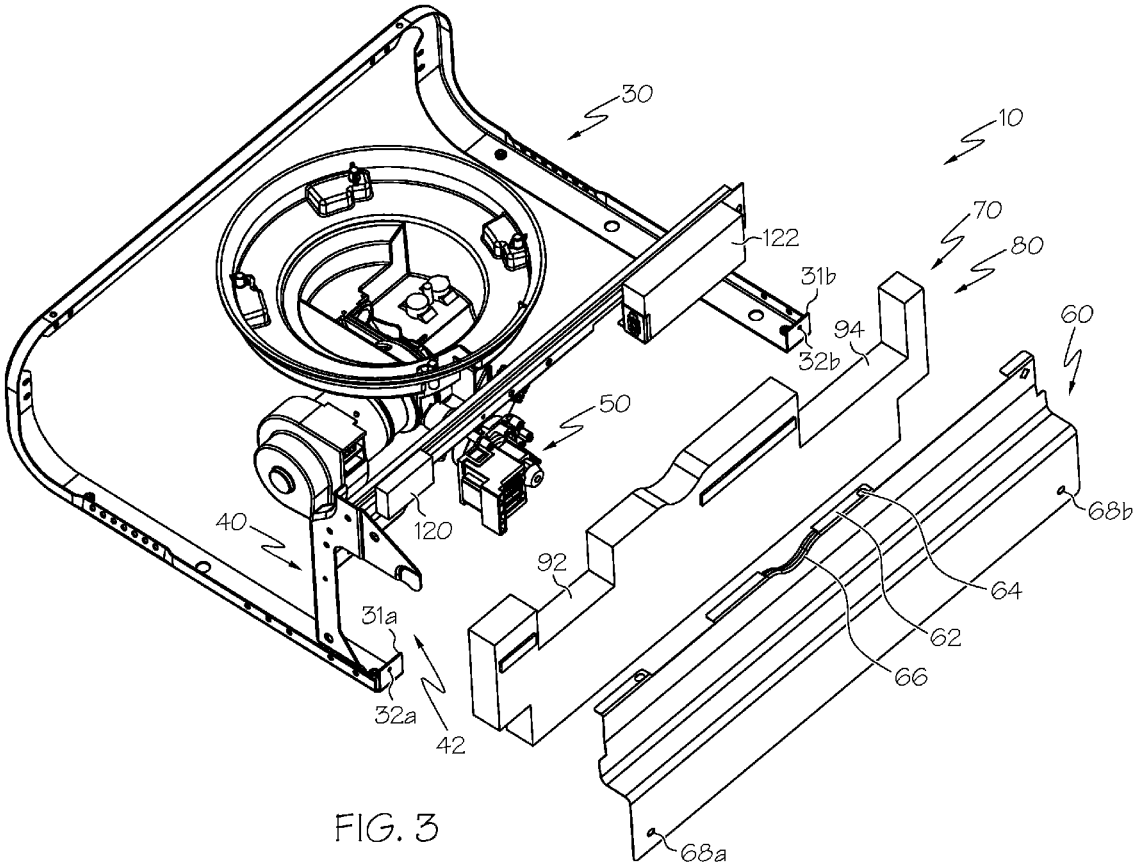
FIG. 3 is an exploded upper perspective view of lower portions of an example dishwasher apparatus incorporating aspects of the present invention.
Figure 4:
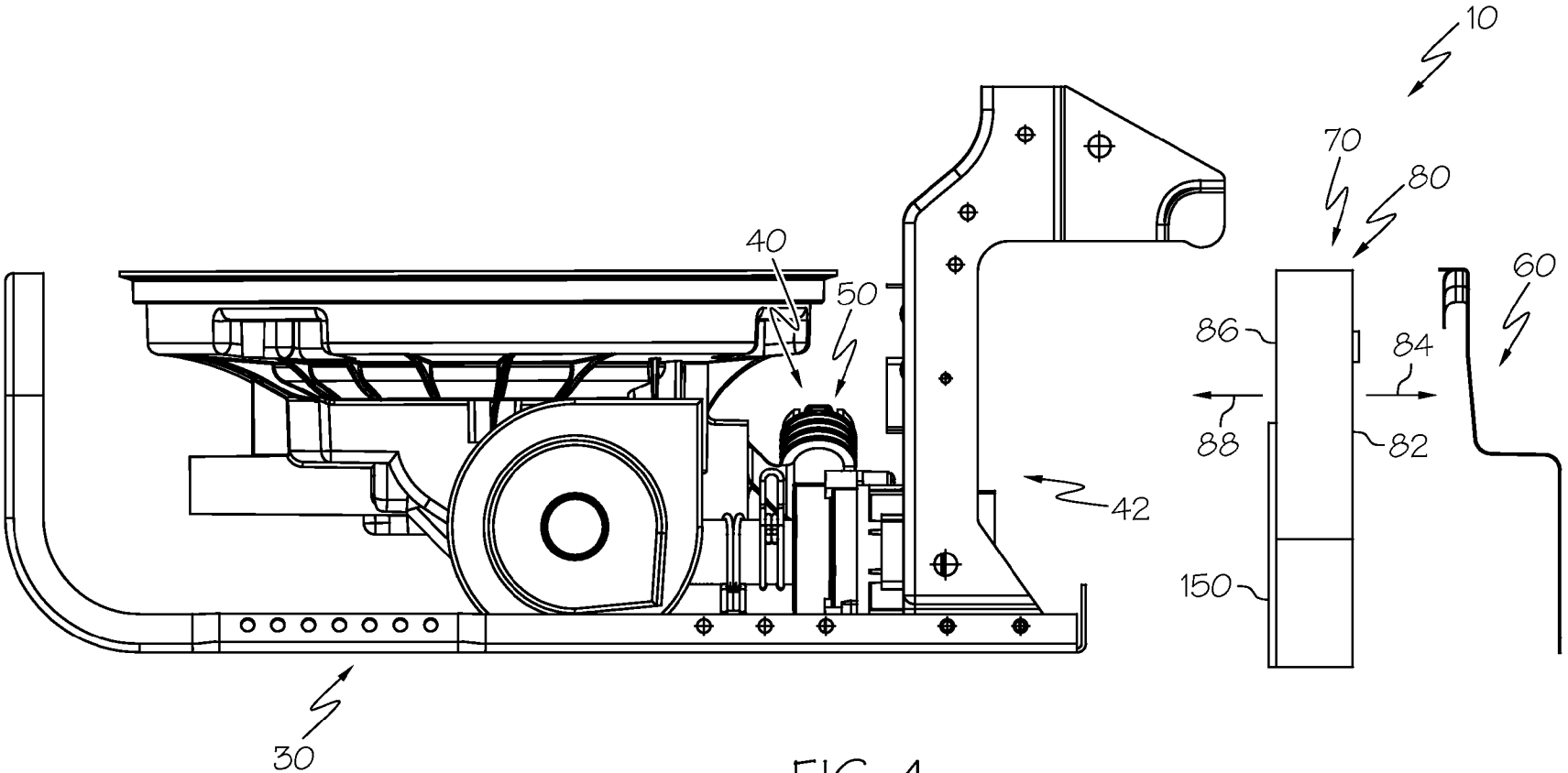
FIG. 4 is a side elevational exploded view of the lower portions of the example dishwasher apparatus of FIG. 3.

The dishwasher apparatus 10 can also include a motor cavity 40 configured to receive one or more dishwasher components therein. For example, the motor cavity can be configured to at least partially receive circulation motors, fluid input motors, or other motors. As shown in FIGS. 1, 3 and 4, in one example, a drain motor 50 may be positioned within the motor cavity 40. As shown in FIGS. 3 and 4, the dishwasher apparatus 10 can include an access opening 42 into the motor cavity 40 to permit service of one or more components within the cavity 40. The motor cavity can be defined at one or more various locations of the dishwasher apparatus 10. For example, the motor cavity may be located above, behind, at a side or other locations of the dishwasher apparatus. As shown, the motor cavity 40 can be located at least partially beneath the wash tub 20 of the dishwasher apparatus 10.

Figure 2:
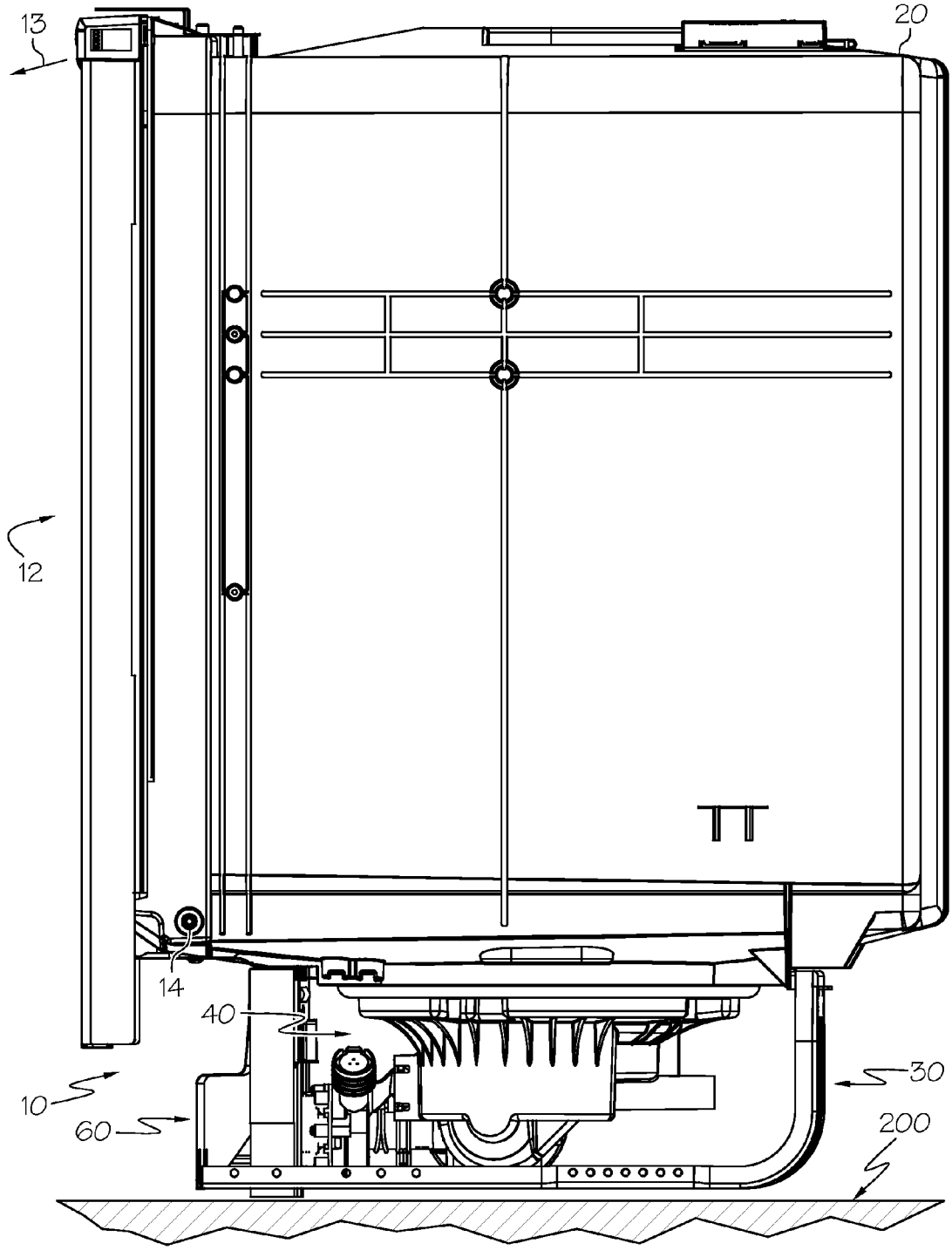
FIG. 2 is a side elevational view of the portions of the example dishwasher apparatus of FIG. 1.

As further illustrated in FIG. 2, the dishwasher apparatus 10 can be configured to rest on a support surface 200, such as the floor of a room. In further examples, the dishwasher apparatus 10 can be supported by other support surfaces such as a shelf, table top, portion of a cabinet, surface of another appliance, or the like. As further illustrated in FIG. 2, the motor cavity 40 can be at least partially positioned between a portion of the wash tub 20 and the support surface 200. In addition, or alternatively, the motor cavity 40 may be positioned at one or more other alternative locations in further examples.

The motor cavity 40 can be provided in a wide variety of ways. For instance, the dishwasher apparatus 10 can include a frame 30 configured to support the wash tub 20 to help define the motor cavity. Indeed, as shown, the frame 30 can support the wash tub 20 at an elevated position with respect to the support surface 200 to define the motor cavity 40 underneath the wash tub 20. The motor cavity 40 can provide room for a drain motor 50 and/or other components of the dishwasher apparatus 10. In addition, or alternatively, the frame 30 can also be configured to support the dishwasher door 12 relative to the wash tub 20. In such examples, the frame 30 can be designed to withstand forces applied by the wash tub 20 and/or the dishwasher door 12. The frame 30, if provided, can be fabricated from various materials capable of supporting components of the dishwasher apparatus 10. For example, the frame 30 may be comprise of metal, plastic, ceramic, composite, and/or other material sufficient to provide support for the wash tub 20 and/or the dishwasher door 12.

The dishwasher apparatus 10 can further include a cover member 60 configured to substantially cover the access opening 42 into the motor cavity 40. The cover member can be configured to be removably attached with respect to the frame 30 and/or other components of the dishwasher apparatus 10 to permit selective access to the motor cavity 40 by way of the access opening 42. Access to the motor cavity may be desirable to clean the support surface 200 underlying the dishwasher apparatus 10 can also facilitate servicing of the dishwasher components located within the motor cavity 40. Various structures may be provided to permit selective removal of the cover member 60. For example as shown in FIG. 3, the cover member 60 can include at least one flange 62 with a detent or opening 64 configured to receive a dimple or protrusion (not shown) extending from the frame 30, the wash tub 20 and/or other components of the dishwasher apparatus 10. Further, as shown, a lower portion of the cover member 60 may include a pair of apertures 68*a*, 68*b* that are each configured to be aligned with a corresponding one of a pair of apertures 32*a*, 32*b* defined in respective tabs 31*a*, 31*b* in the front portion of the frame 30. A fastener (not shown) may be inserted through each aperture 68*a*, 68*b* of the cover member 60 and threaded into the corresponding aperture 32*a*, 32*b* of the frame 30. In further examples, the cover member may be snapped into place or otherwise removably attached with respect to the access opening 42. It is still further contemplated that the cover member 60 may be designed to permanently seal off the access opening in still further examples.

As further illustrated, the dishwasher apparatus 10 can further include a sound absorbing device 70. The sound absorbing device 70 includes a sound absorbing element 80 configured to absorb sound originating from components within the motor cavity 40 from being emitted through the cover member 60. In one example, the sound absorbing element 80 can comprise an acoustical insulation blanket that may be formed from an acoustical insulating mat formed from a fibrous material. In one example, the fibrous material can comprise fibrous polyester configured to provide sound-absorbing properties. Although a wide range of materials may be used, one type of sound absorbing element 80 can comprise a VersaMat® acoustical insulation blanket sold by Owens Corning.

Figure 5:
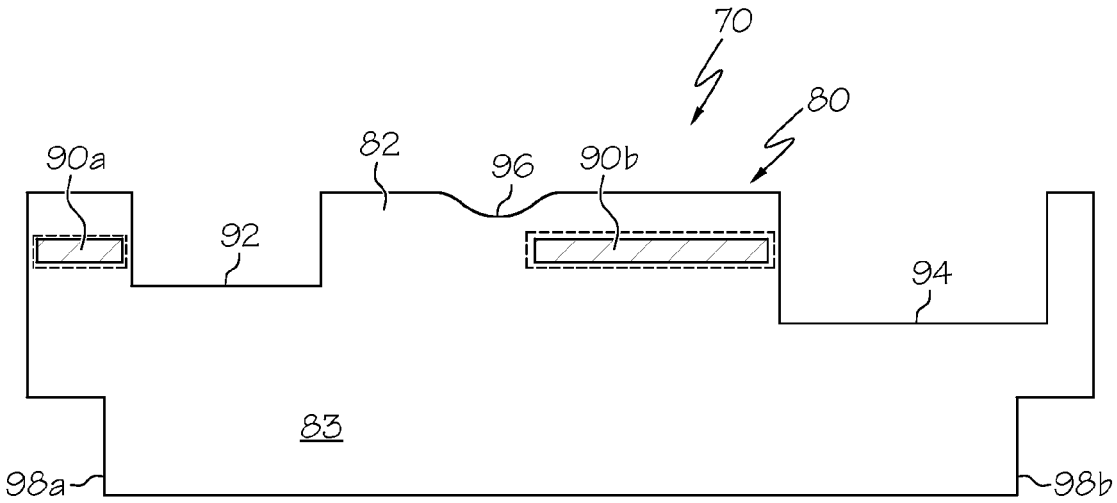
FIG. 5 is an elevational view of a first side of a sound absorbing device incorporating aspects of the present invention.
Figure 6:
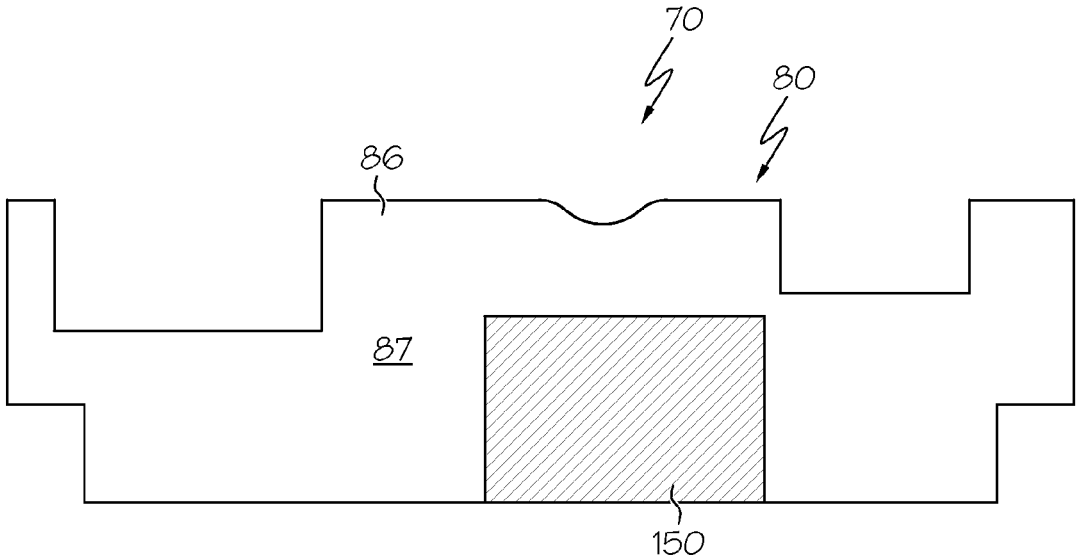
FIG. 6 is an elevational view of a second side of the sound absorbing device of FIG. 5.

As further shown in FIGS. 4-6, the sound absorbing element 80 can include an acoustical insulation blanket including a first side 82 having a first area 83 facing a first direction 84 and a second side 86 including a second area 87 facing a second direction 88 opposite the first direction 84. The first side 82 of the insulation blanket can be attached to the cover member 60. As shown in FIG. 5, adhesive strips 90*a*, 90*b* may be provided to attach the insulation blanket to the cover member 60 although the insulation blanket may be attached in a wide variety of ways. For example, a hook and loop type fastener or other mechanical fastening apparatus may be used to provide removable attachment.

The sound absorbing element 80 may also include a wide variety of shapes and sizes depending on the particular application. As shown, in FIGS. 5 and 6, the sound absorbing element 80 may have cut out areas configured to provide significant coverage over the cover member 60 while providing clearance for frame or other components of the dishwasher apparatus 10. For example, referencing FIGS. 3 and 5, the sound absorbing element 80 may include an upper left cut out 92 to receive portions of a float switch 120 that may be mounted to the frame 30 of the dishwasher apparatus 10. The sound absorbing element 80 can further include an upper right cut out 94 configured to receive portions of a junction box 122 may also be mounted on the frame 30. The upper portion of the sound absorbing element 80 may also include a groove 96 configured to be aligned with a similarly-shaped groove 66 on the cover member 60 to provide clearance for an electrical cable or conduit for electrical controls or other components located within the dishwasher door 12. The lower portion of the cover member 60 can also include lower lateral notches 98*a*, 98*b* configured to receive the respective tabs 31*a*, 31*b* of the frame 30.

The sound absorbing device 70 further includes a motor guard 150. The motor guard 150 can be designed to thermally shield the sound absorbing element 80 from the motor 50. Thus, the motor guard 150 can help protect the sound absorbing element from thermal damage due to heat from the motor 50. In addition, or alternatively, the motor guard 150 can provide a dielectric shield between the motor 50 and the sound absorbing element 80. Thus, the motor guard 150 can act to inhibit, such as prevent, electrical current from passing from the motor to the sound absorbing element 80. Still further, the motor guard 150 can be configured to transmit vibrational energy from the motor 50 to the sound absorbing element 80. For example, the motor 50 may engage the motor guard 150 such that vibrational energy from the motor 50 is transmitted through the motor guard 150 to the sound absorbing element 80. Once transmitted, the sound absorbing element 80 can absorb the vibrational energy, thereby inhibiting release of sound from the motor cavity 40.

The motor guard 150 can be fabricated from a wide range of materials, sizes and/or configurations to provide the desired thermal shielding, dielectric shielding and/or noise transmission characteristics. In one example, the motor guard 150 can comprise a talc filled copolymer polypropylene although other material types may be used in further examples. The talc filled copolymer polypropylene or other material can be formed as a substantially rigid material with a density of approximately 1.39 g/cm$^3$, although other material characteristics may be provided in further examples.

As shown in the drawings, the motor guard 150 can be attached to the second sound absorbing element 80, such as the second side 86 of the acoustical insulation blanket. The motor guard 150 can be attached to the acoustical insulation blanket by an adhesive, mechanical fastener or other attachment mechanism. As shown, the motor guard 150 can also be attached such that a portion of the motor guard is positioned between a portion of the motor 50 and a portion of the sound absorbing element 80. As further shown in the drawings, a portion of the sound absorbing element 80 can be positioned between a portion of the cover member 60 and the motor guard 150.

As shown in FIG. 6, the sound absorbing element 80 comprises an acoustical insulation blanket wherein the motor guard 150 is attached to the second side 86 of the acoustical insulation blanket. In one example, the motor guard 150 can be configured to cover less than the entire second area 87 of the second side 86 of the acoustical insulation blanket. For instance, the motor guard 150 can be designed to substantially cover less than about 75% of the second area 87 of the acoustical insulation blanket. In further examples, the motor guard 150 can be designed to substantially cover less than about 50% of the second area 87 of the acoustical insulation blanket. In still further examples, the motor guard 150 can be designed to substantially cover less than about 25% of the second area 87 of the acoustical insulation blanket. In still further examples, the motor guard 150 can be designed to substantially cover about 20% of the second area 87 of the acoustical insulation blanket. Reducing the coverage of the motor guard over the second area can reduce the material costs of the motor guard 150 while still providing desirable thermal shielding, dielectric shielding and/or noise transmission characteristics.

From the above description of the invention, those skilled in the art will perceive improvements, changes and modifications. Such improvements, changes and modifications within the skill of the art are intended to be covered by the appended claims.

What is claimed:

1. A dishwasher apparatus comprising:
a wash tub;
a motor cavity;
a motor positioned within the motor cavity;
a cover member configured to substantially cover an access opening into the motor cavity; and
a sound absorbing device comprising a sound absorbing element attached to the cover member, and a motor guard attached to the sound absorbing element, wherein a portion of the motor guard is positioned laterally between a portion of the motor and a portion of the sound absorbing element and the portion of the sound absorbing element is positioned laterally between a portion of the cover member and the portion of the motor guard.

2. The dishwasher apparatus of claim 1, wherein the motor guard is configured to provide the portion of the sound absorbing element with thermal shielding from the motor.

3. The dishwasher apparatus of claim 1, wherein the motor guard is configured to provide a dielectric shield between the motor and the sound absorbing element.

4. The dishwasher apparatus of claim 1, wherein the motor guard is configured to transmit vibrational energy to the portion of the sound absorbing element.

5. The dishwasher apparatus of claim 1, wherein the motor engages the motor guard.

6. The dishwasher apparatus of claim 1, wherein the motor guard comprises a substantially rigid material.

7. The dishwasher apparatus of claim 1, wherein the motor guard comprises a talc filled copolymer polypropylene.

8. The dishwasher apparatus of claim 1, wherein the motor guard has a density of approximately 1.39 g/cm$^3$.

9. The dishwasher apparatus of claim 1, wherein the sound absorbing element comprises an acoustical insulation blanket including a first side having a first area facing a first direction and a second side including a second area facing a second direction opposite the first direction, wherein the first side of the acoustical insulation blanket is attached to the cover member and the motor guard is attached to the second side of the acoustical insulation blanket.

10. The dishwasher apparatus of claim 9, wherein the motor guard substantially covers less than about 75% of the second area of the acoustical insulation blanket.

11. The dishwasher apparatus of claim 9, wherein the motor guard substantially covers less than about 50% of the second area of the acoustical insulation blanket.

12. The dishwasher apparatus of claim 9, wherein the motor guard substantially covers less than about 25% of the second area of the acoustical insulation blanket.

13. The dishwasher apparatus of claim 9, wherein the motor guard substantially covers about 20% of the second area of the acoustical insulation blanket.

14. A dishwasher apparatus comprising:
a wash tub;
a motor cavity;
a motor positioned within the motor cavity;
a cover member configured to substantially cover an access opening into the motor cavity; and
a sound absorbing device comprising a motor guard and an acoustical insulation blanket including a first side including a first area facing a first direction and a second side including a second area facing a second direction opposite the first direction, wherein the cover member is attached to the first side of the acoustical insulation blanket and the motor guard is attached to the second side of the acoustical insulation blanket, a portion of the motor guard is positioned laterally between a portion of the motor and a portion of the acoustical insulation blanket, the portion of the acoustical insulation blanket is positioned laterally between a portion of the cover member and the portion of the motor guard, and the motor guard substantially covers less than about 75% of the second area of the acoustical insulation blanket.

15. The dishwasher apparatus of claim 14, wherein the motor guard substantially covers less than about 50% of the second area of the acoustical insulation blanket.

16. The dishwasher apparatus of claim 14, wherein the motor guard substantially covers less than about 25% of the second area of the acoustical insulation blanket.

17. The dishwasher apparatus of claim 14, wherein the motor guard comprises a substantially rigid material.

18. The dishwasher apparatus of claim 14, wherein the motor guard comprises a talc filled copolymer polypropylene.

19. The dishwasher apparatus of claim 14, wherein the motor guard has a density of approximately 1.39 g/cm$^3$.

20. A dishwasher apparatus comprising:
a wash tub;
a motor cavity;
a motor positioned within the motor cavity;

a cover member configured to substantially cover an access opening into the motor cavity; and a sound absorbing device comprising an acoustical insulation blanket including a first side having a first area facing a first direction and a second side including a second area facing a second direction opposite the first direction, wherein the first side of the acoustical insulation blanket is attached to the cover member, the sound absorbing device further including a motor guard attached to the second side of the acoustical insulation blanket and substantially covering less than about 75% of the second area of the acoustical insulation blanket, the motor guard comprising a substantially rigid material and configured to provide the portion of the sound absorbing device with thermal shielding from the motor, wherein a portion of the motor guard is positioned laterally between a portion of the motor and a portion of the acoustical insulation blanket and the portion of the acoustical insulation blanket is positioned laterally between a portion of the cover member and the portion of the motor guard.

* * * * *